US011565784B2

(12) United States Patent
Enriquez et al.

(10) Patent No.: US 11,565,784 B2
(45) Date of Patent: Jan. 31, 2023

(54) PROPULSION RUDDER FOR A WATER DRONE

(71) Applicant: SWL Robotics, Inc., Miami, FL (US)

(72) Inventors: Enrique Jesus Enriquez, Miami, FL (US); Carlos Alberto Valencia, Miami, FL (US); Enrique Frecci Enriquez, Miami, FL (US); Ricardo Enriquez, Miami, FL (US)

( * ) Notice: Subject to any disclaimer, the term of this patent is extended or adjusted under 35 U.S.C. 154(b) by 93 days.

(21) Appl. No.: 17/323,786

(22) Filed: May 18, 2021

(65) Prior Publication Data

US 2021/0362820 A1 Nov. 25, 2021

Related U.S. Application Data

(60) Provisional application No. 63/027,020, filed on May 19, 2020.

(51) Int. Cl.

| | |
|---|---|
| ***B63H 25/38*** | (2006.01) |
| ***B63H 7/02*** | (2006.01) |
| ***B63H 25/04*** | (2006.01) |
| *B63H 25/06* | (2006.01) |

(52) U.S. Cl.

CPC ..... *B63H 25/38* (2013.01); *B63H 7/02* (2013.01); *B63H 25/04* (2013.01); *B63H 2025/045* (2013.01); *B63H 2025/066* (2013.01)

(58) Field of Classification Search

CPC . B63H 7/00; B63H 7/02; B63H 25/00; B63H 25/04; B63H 25/38; B63H 2025/045; B63H 2025/066; B60V 1/11; B60V 1/14

USPC ..... 114/162; 440/37

See application file for complete search history.

(56) References Cited

U.S. PATENT DOCUMENTS

| | | | | | |
|---|---|---|---|---|---|
| 1,842,125 | A * | 1/1932 | Schwarz | B63H 7/02 | 244/51 |
| 5,273,238 | A * | 12/1993 | Sato | B60V 1/08 | 114/273 |
| 5,279,379 | A * | 1/1994 | Sixsmith | B60V 1/14 | 180/117 |
| 5,398,628 | A * | 3/1995 | Rethorst | B63B 1/28 | 114/274 |
| 5,711,494 | A * | 1/1998 | Saiz | B60V 1/22 | 114/283 |
| 11,066,059 | B2 * | 7/2021 | Hakala | B60V 1/11 | |

* cited by examiner

*Primary Examiner* — Lars A Olson
(74) *Attorney, Agent, or Firm* — Michael A DiNardo

(57) ABSTRACT

A propulsion rudder for use with a water vessel, preferably an unmanned surface water vessel. The propulsion rudder includes a rotating base, a rudder assembly, and a thrust assembly. In one embodiment, the rudder assembly may comprise two vertical mast rudders connected by an upper horizontal wing, with the thrust assembly mounted on the horizontal wing. In a second embodiment, the rudder assembly may comprise an annular airfoil with the thrust assembly mounted on a mast and positioned in the center of the annular airfoil. The thrust assembly may be a propeller, a turbine, a ramjet, or a rocket.

19 Claims, 8 Drawing Sheets

PROPULSION RUDDER FOR A WATER DRONE

RELATED APPLICATIONS

This application claims the benefit of U.S. Provisional Patent Application Ser. No. 63/027,020 filed May 19, 2020.

BACKGROUND OF THE INVENTION

The present invention is directed to a propulsion rudder for a water-based drone. Specifically, the inventive propulsion rudder has an integrated power/control module that provides for effective horizontal steering in any direction.

It is the purpose of the invention to create an integrated power/control module system that can more effectively guide water surface vessels, preferably unmanned drones. The inventive system also aides in maintaining vessel stability, position, an orientation when said vessel is not under propulsion. Current unmanned water drones rely on less efficient thrust and steering designs.

Accordingly, there is a need for an improved thrust design for a water-based vessel that produces sufficient thrust and provides adequate steering control. The present invention fulfills these needs and provides other related advantages.

SUMMARY OF THE INVENTION

It is one purpose of this invention to create an integrated power and control module that can more effectively guide surface water vessels. The inventive system will also aide in maintaining vessel stability, position and orientation when said vessel is not been propelled forward. By integrating a rotating base with a rudder assembly and a trust module (i.e., power motor(s), propeller(s), a horizontal wing and vertical rudder(s) on a rotating circular plate as in the first preferred embodiment), the vessel can effectively be steered horizontally in any direction. The module can be integrated into the initial construction of vessels or retrofitted to existing vessels.

Furthermore, by having the capability of rotating through a range of 360 degrees (180 degrees on each direction from a zero point) the vessel can be completely rotated on an axis without the need of additional steering rudders or elements, above or below the vessel. The horizontal wing may also pivot on the upper end of the rudders and will support the power motor(s) and propeller(s) thus creating some lift to help trim the vessel in a longitudinal axis. The trim can be negative or positive depending on the rotation of the module relative to the zero point.

The rotation of the circular plate and the pivoting of the horizontal wing, can be accomplished with devices, including but not limited to, smart servos and stepper motors. These actuating devices will be able to receive and send data to an onboard computer equipped with GPS and a gyroscope that in turn can control and guide the vessel. The system is connected to the battery onboard the vessel and can be programmed to help a vessel conduct autonomous runs, maintain the vessel on a desired position-location-orientation and help it get out of situations encountered by vessels that navigate near coastlines such as sea weed, mangroves, sand etc.

The present invention is directed to a propulsion rudder for a water vessel. The propulsion rudder includes a generally circular base rotatingly attached to an upper surface of the water vessel. The base is configured to rotate through three hundred sixty degrees around a vertical axis relative to the water vessel. In particular, the base may rotate one-hundred eighty degrees in each of clockwise and counter-clockwise directions relative to a zero point. An aerodynamic rudder assembly is attached to the base and extends above the upper surface of the water vessel. A thrust assembly is operationally connected to the rudder assembly, wherein the thrust assembly produces a thrust vector generally perpendicular to the vertical axis.

In a first preferred embodiment, the rudder assembly comprises two mast rudders attached to the base spaced equidistant to either side of the vertical axis about which the base is configured to rotate. An aerodynamic horizontal wing spans between the two mast rudders. The horizontal wing is configured to move at a pivot angle in a range of about forty-five degrees above and forty-five degrees below a horizontal plane. The thrust assembly is preferably attached to the horizontal wing between the two mast rudders and the thrust vector is aligned with the pivot angle of the horizontal wing.

The propulsion rudder also includes an onboard computer operationally connected to the base so as to rotate the same. The onboard computer is also operationally connected to the thrust assembly so as to control the thrust vector. The onboard computer comprises a GPS module and a gyroscope configured to calculate position and orientation of the water vessel.

In a second preferred embodiment, the rudder assembly includes an annular airfoil attached to the base such that the vertical axis about which the base is configured to rotate passes through a center of the annular airfoil. A central mast that extends from the base to the center of the annular airfoil, wherein the thrust assembly is attached to the central mast and disposed at the center of the annular airfoil. The thrust assembly may be a propeller, a turbine, a ramjet, or a rocket.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
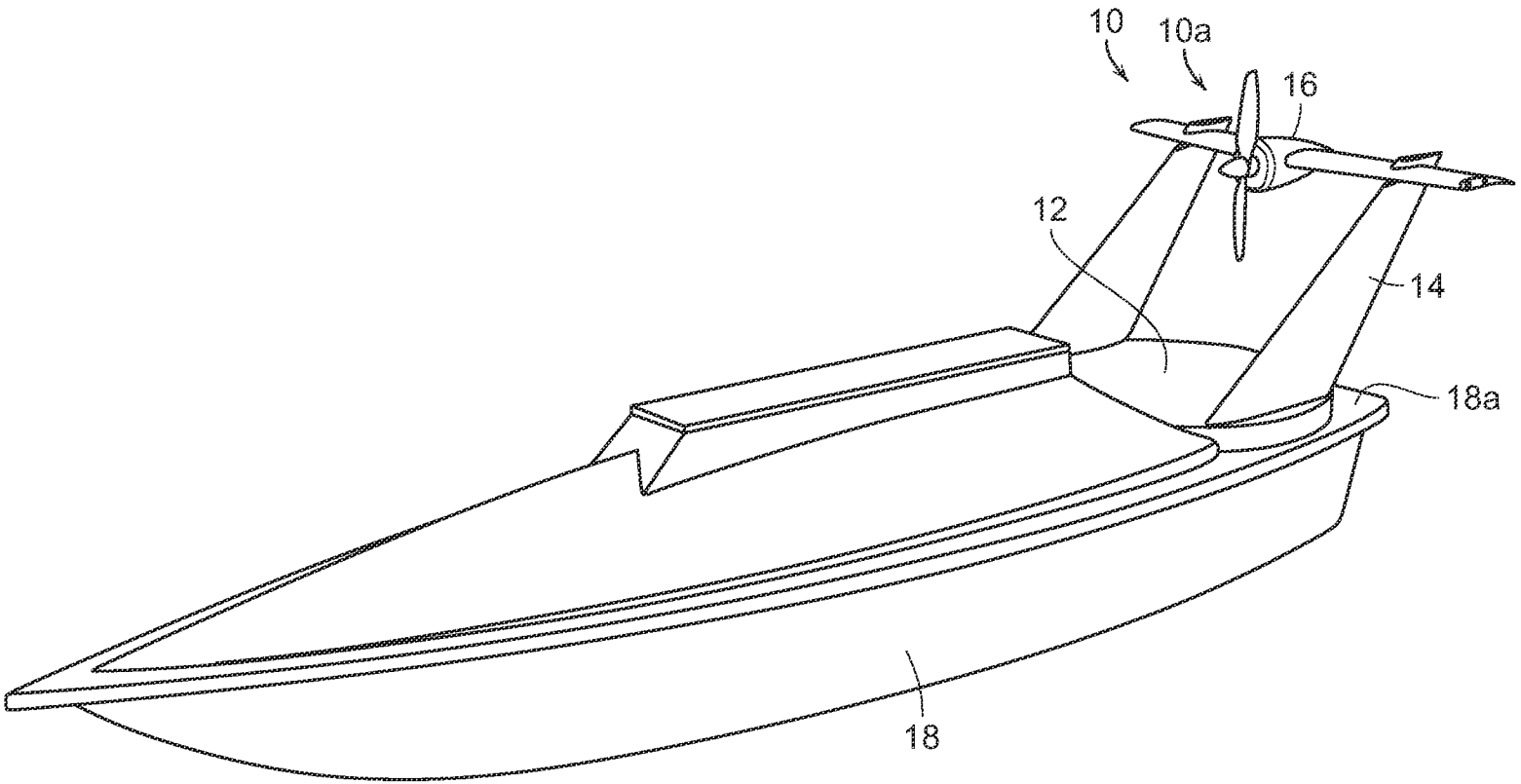
FIG. 1 is a perspective view of a water vessel including the first preferred embodiment of the inventive propulsion rudder.
Figure 2:
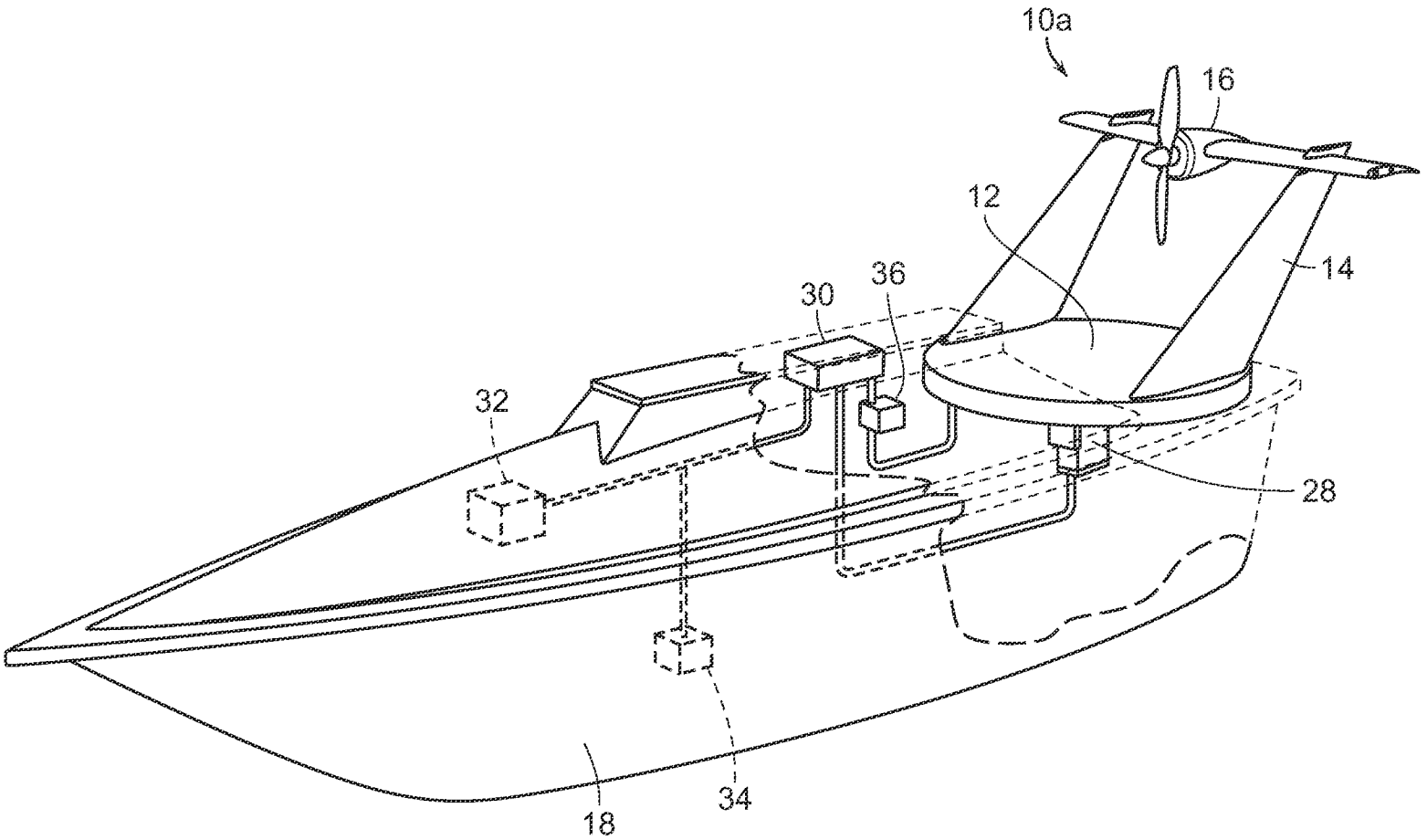
FIG. 2 is a partial cut-away, perspective view of the water vessel of FIG. 1.
Figure 3:
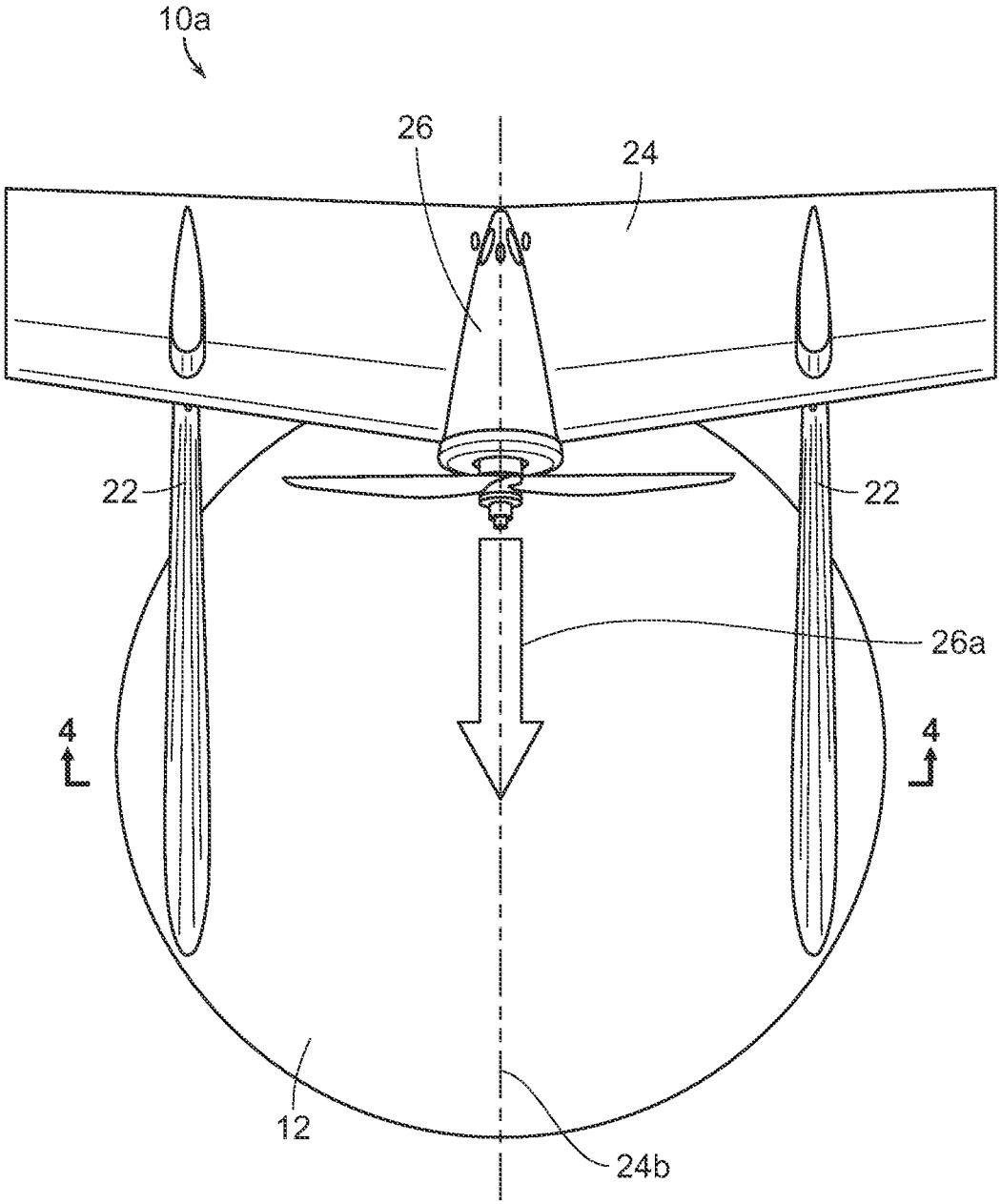
FIG. 3 is a top view of the first preferred embodiment of the inventive propulsion rudder.

The present invention is directed to a propulsion rudder for water vessels, the propulsion rudder is generally referred to by reference numeral 10 in FIGS. 1-8, which generally includes a base 12, a rudder assembly 14, and a thrust assembly 16. The following detailed description will cover two preferred embodiments of the inventive propulsion rudder 10*a*, 10*b*, although the propulsion rudder 10 can be configured on other ways.

The rudder 10*a*, 10*b* may be positioned anywhere along a longitudinal axis of the vessel provided that the center of the rotating base 12 is located in line with the lateral center of the vessel. The components of the inventive propulsion rudder 10*a*, 10*b* can be of any size, shape and profile, designed to create lift or serve as a neutral airfoil for a particular vessel. In particular embodiments as described in detail below, a wing can pivot on a fixed axis attached to the rudders and the entire rudder can be rotated by any device capable of achieving the required torque and angular rotation. Motors, gear boxes, servos, hydraulic and pneumatic systems may be used to achieve these actions depending on the conditions required by the application. The wing should be designed so as to support a motor/propeller assembly or a plurality of motor/propeller assemblies. The configuration of motor/propeller assemblies may vary in number and location, whether the motor/propeller will be pushing or pulling the vessel.

First Preferred Embodiment

Turning to FIGS. 1-4, the first preferred embodiment of the propulsion rudder 10*a* is shown. The propulsion rudder 10*a* is mounted on an upper surface 18*a* of a water vessel 18. The base 12 is generally circular in shape and is configured to rotate about a vertical axis 20 that passes through a geometric center 12*a* of the base 12. The mounting of the base 12 to the upper surface 18*a* is hermetically sealed against the intrusion of water, but is freely rotatable with no or minimal friction. In one preferred form, the base 12 rotates as on a central hollow shaft that passes through the deck wall and attaches to a rotor assembly. A series of seals or O-rings may be used to prevent the ingress of water.

The rudder assembly 14 extends upward from the base 12 so as to support the thrust assembly 16 a predetermined distance above the upper surface 18*a*. In this preferred embodiment, the rudder assembly 14 has two vertical mast rudders 22 that are attached to the base 12 spaced equidistant from the vertical axis 20 on opposite sides thereof. Ideally, the mast rudders 22 are placed at opposite edges of the base 12 so as to provide the greatest separation between the two mast rudders 22.

The mast rudders 22 preferably have an aerodynamic cross-section from a leading face to a trailing edge. The shape of the rudders 22 is preferably of a neutral airfoil design, since the horizontal steering of the system will depend solely on the angular position of the rotating base 12. The nature of the assembly 10*a* negates the need for flaps or ailerons usually found on conventional rudders to aid in steering. The main function of the rudders 22 will be to support a horizontal wing 24 and to serve as a conduit for power, data wire harnesses, or any sensors or equipment that may be mounted thereon. The rudder 22 configuration may vary in number (single rudder or a plurality of rudders) and their location in relation the motor-propeller assemblies.

In addition, when the base 12 is in a rotational zero position (described below) the mast rudders 22 are preferably swept back from the front of the vessel 18 to toward the rear of the vessel 18.

A horizontal wing 24 is attached to upper ends of the mast rudders 22, distal from the base 12. As with the mast rudders 22, the wing 24 preferably has an aerodynamic cross-section from a leading face to a trailing edge. The wing 24 preferably also has a slight curve, particularly closer to the trailing edge of the wing 24. The attachment between the wing 24 and mast rudders 22 is preferably a pivoting connection, controlled by a servo motor (not shown) so that the wing 24 can alter the angle of incidence with any airflow.

Figure 4:
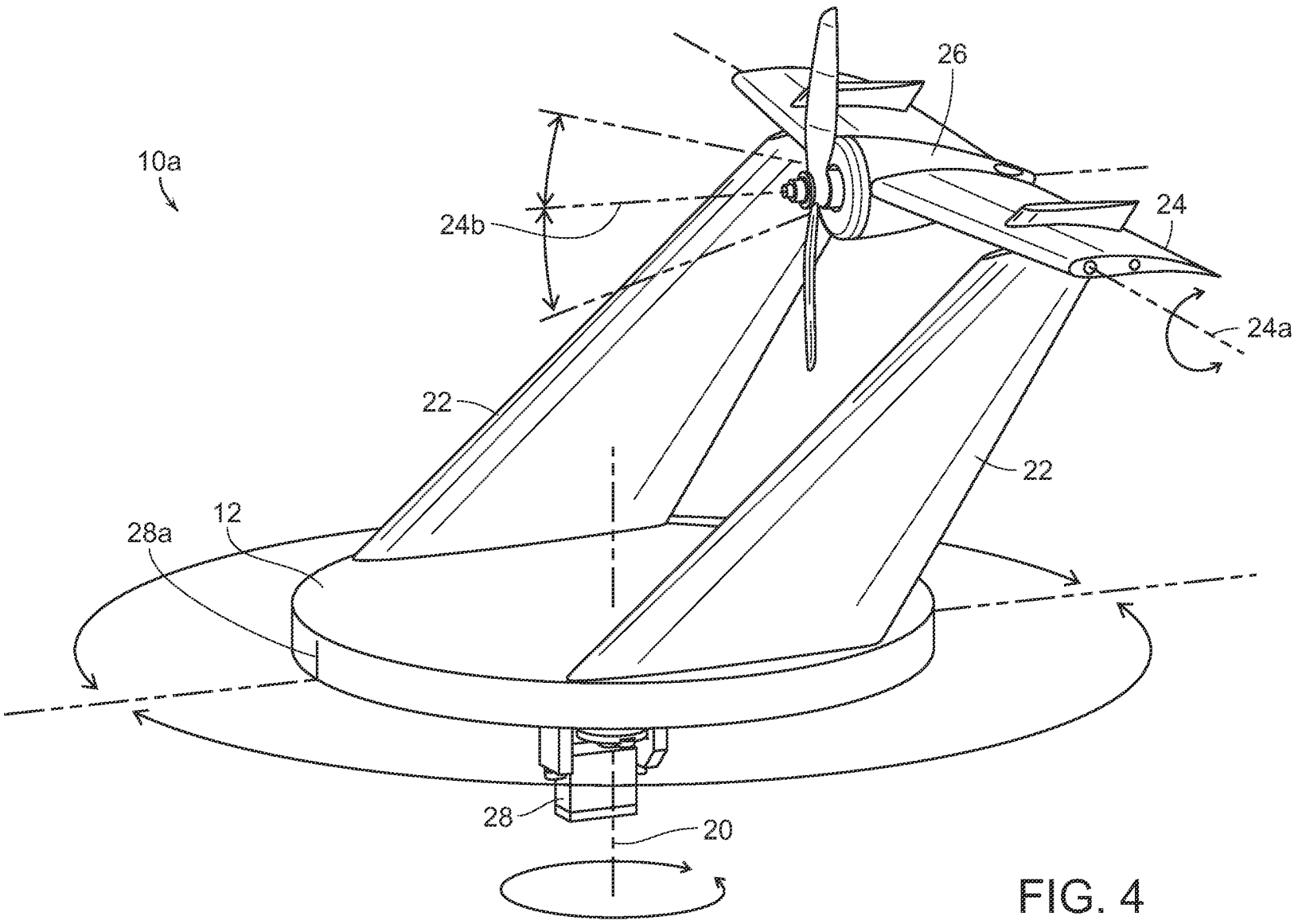
FIG. 4 is a perspective view of the first preferred embodiment of the inventive propulsion rudder.
Figure 5:
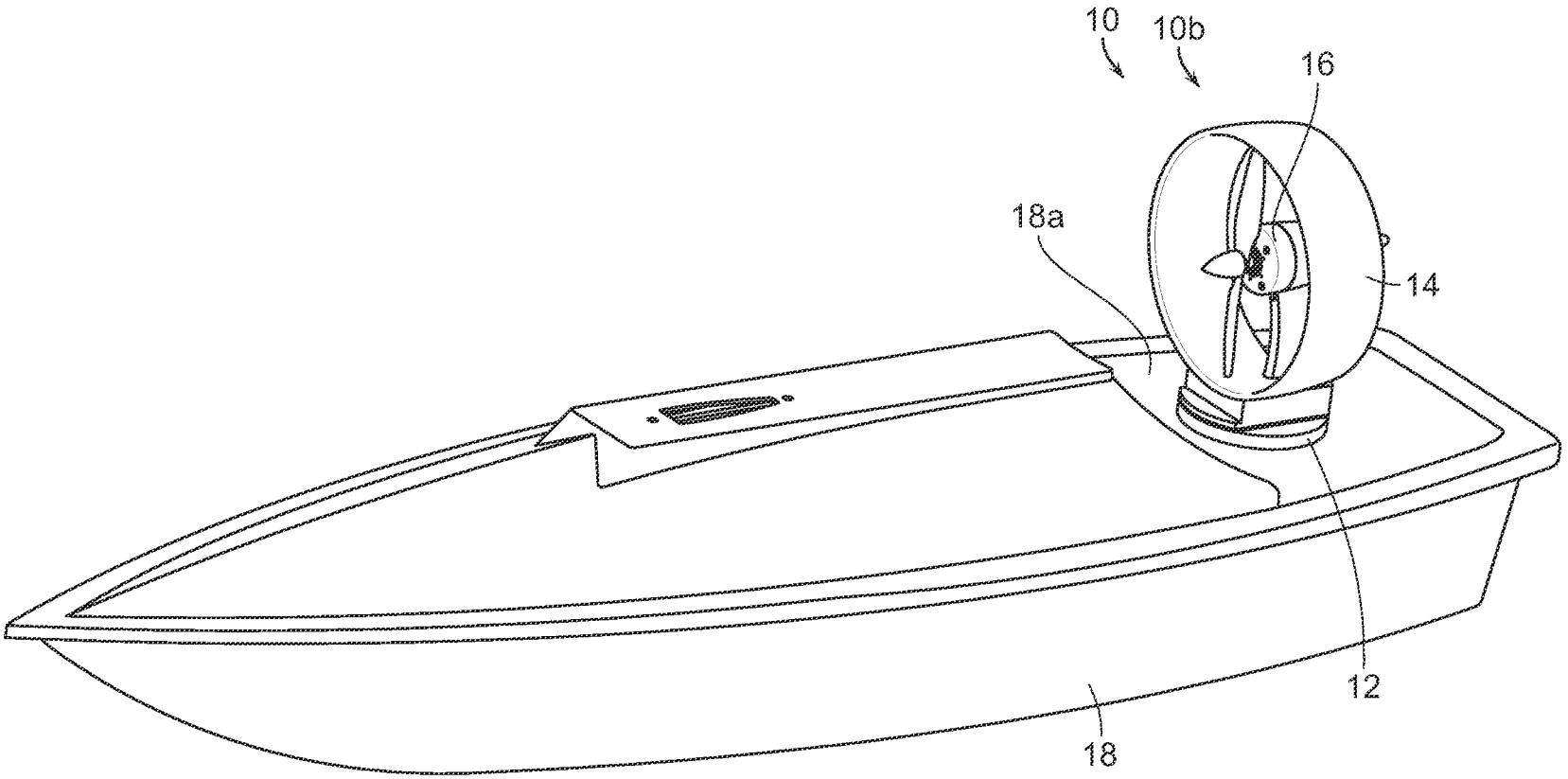
FIG. 5 is a perspective view of a water vessel including a second preferred embodiment of the inventive propulsion rudder.
Figure 6:
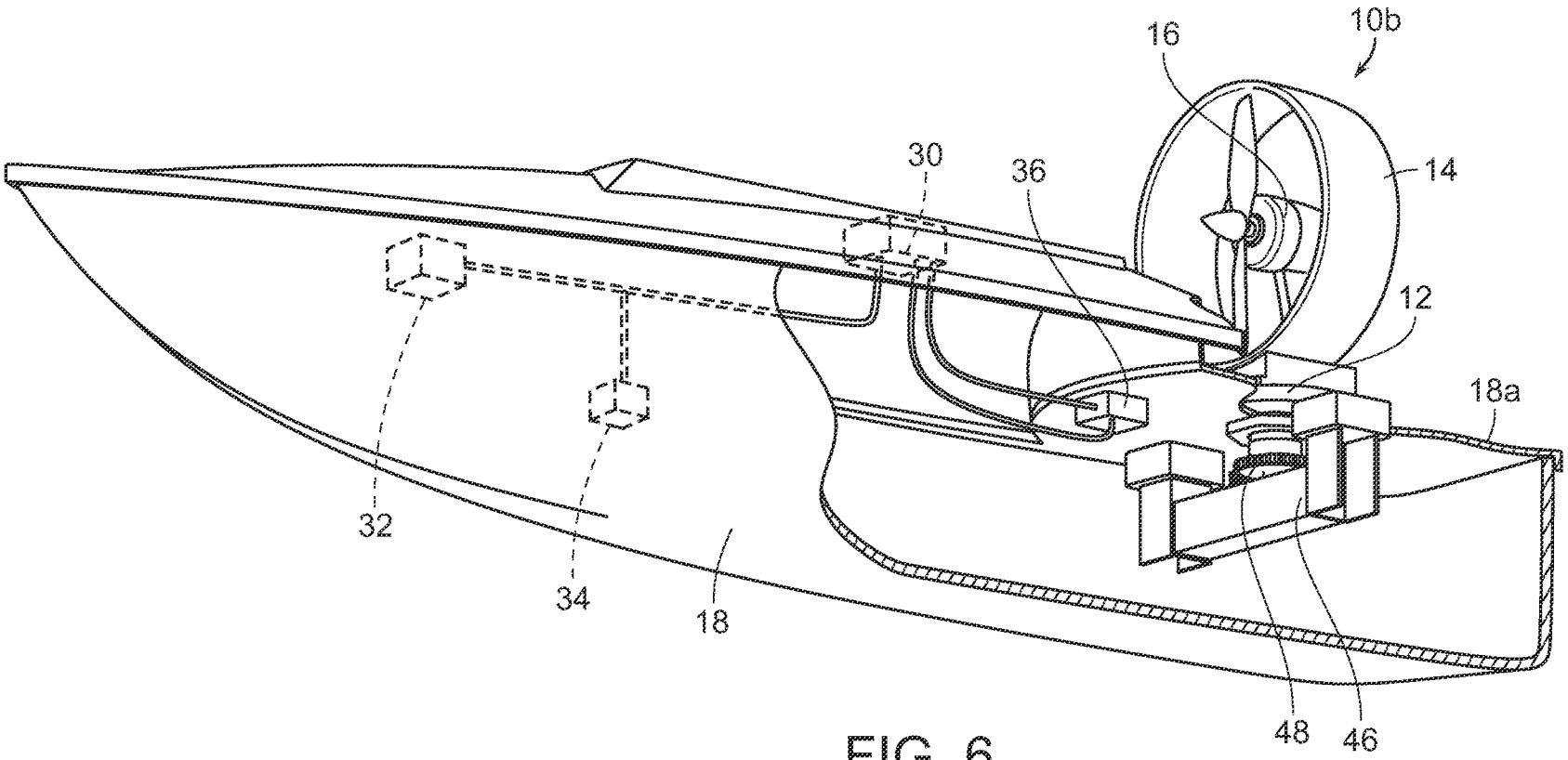
FIG. 6 is a partial cut-away, perspective view of the water vessel of FIG. 5.

As shown in FIG. 4, the wing 24 may pivot about a lateral axis 24*a* that is proximate to the leading face. When pivoting, the wing 24 may pivot above or below a horizontal plane defined by the lateral axis 24*a* and a longitudinal axis 24*b*. The range of pivoting is preferably limited to a range of forty-five degrees above and forty-five degrees below the horizontal plane.

The thrust assembly 16 is preferably attached to the rudder assembly 14. In this particular embodiment, the thrust assembly 16 comprises a propeller engine 26, but may also comprise a turbine, a ramjet, a rocket, or other know or yet to be discovered propulsion system. The propeller engine 16 is attached to the wing 24, preferably integral therewith. Because of its integral construction, the propeller engine 16 matches the pivoting of the wing 24 described above such that a thrust vector 26*a* matches the pivot angle. The thrust vector 26*a* is configured to be aligned with the propeller engine 26 and propel the vessel 18 in the direction in which it is pointed.

Beneath the base 12, a rotating servo motor 28 is attached to the center 12*a* so as to control rotational movement thereof. The motor 28 is configured to rotate the base through three-hundred sixty degrees. To minimize over rotation of the propulsion rudder 10, the motor 28 is preferably restricted to alternately rotate the base 12 relative to a zero point 28*a*. The zero point 28*a* corresponds to a front of the vessel 18 that aligns the leading faces of the rudders 22 and wing 24 therewith.

The motor 28 is configured to rotate the base 12 one-hundred eighty degrees in either a clockwise or counter-clockwise direction—stopping when the base has rotated one-hundred eighty degrees in either direction. Limiting rotation of the base 12 in this manner provides for more reliable propulsion control of the vessel 18. To the extent the base 12 may be rotated away from the zero point 28*a*, the direction of the thrust vector 26*a* can effectively steer the vessel 18, or even propel the vessel 18 in reverse.

The propulsion rudder 10*a* also includes an onboard computer 30 that is operably connected to the motor 28, as well as, is operably connected to the pivot motor (not shown) on the wing 24 and the thrust assembly 16. The computer 30 includes a GPS module 32, a gyroscope 34, and a speed controller 36. The combined function of the GPS module 32, gyroscope 24, and speed controller 36 allows for the computer 30 to control the propulsion rudder 10*a* so as to steer and drive the vessel 18. With a computer 30 configured in this manner, the propulsion rudder 10*a* is particularly adapted for use with a vessel 18 that is an unmanned drone or similar unmanned vehicle.

Second Preferred Embodiment

Turning to FIGS. 5-8, the second preferred embodiment of the propulsion rudder 10*b* is shown. As with the first embodiment, the second preferred embodiment of the propulsion rudder 10*b* includes a base 12, a rudder assembly 14, and a thrust assembly 16, all of which are mounted on the upper surface 18*a* of a water vessel 18. The base 12 includes a geometric center 12*a* and a vertical axis 20 about which the base is rotatable.

In contrast to the first embodiment, the rudder assembly 14 of the second preferred embodiment comprises an annular airfoil 40 that is attached to the base 12 and generally centered on the axis of rotation 20. An annular geometric center 40*a* of the airfoil 40 is perpendicular to the vertical axis of rotation 20 and aligned with the zero point 28*a*.

In further contrast to the first embodiment, the thrust assembly 16 of the second preferred embodiment comprises a central mast 42 that extends upward from the base 12. The thrust engine 44 is mounted on top of the central mast 42, such that the engine 44 is positioned in the geometric center 40*a* of the airfoil 40. As discussed above, the thrust engine 44 may comprise a propeller engine 44 (as shown), a turbine, a ramjet, a rocket or another type of propulsion engine known or yet to be discovered. The thrust vector 44*a* of the propeller engine 44 is aligned with the geometric center 40*a* of the airfoil 40.

Figure 7:
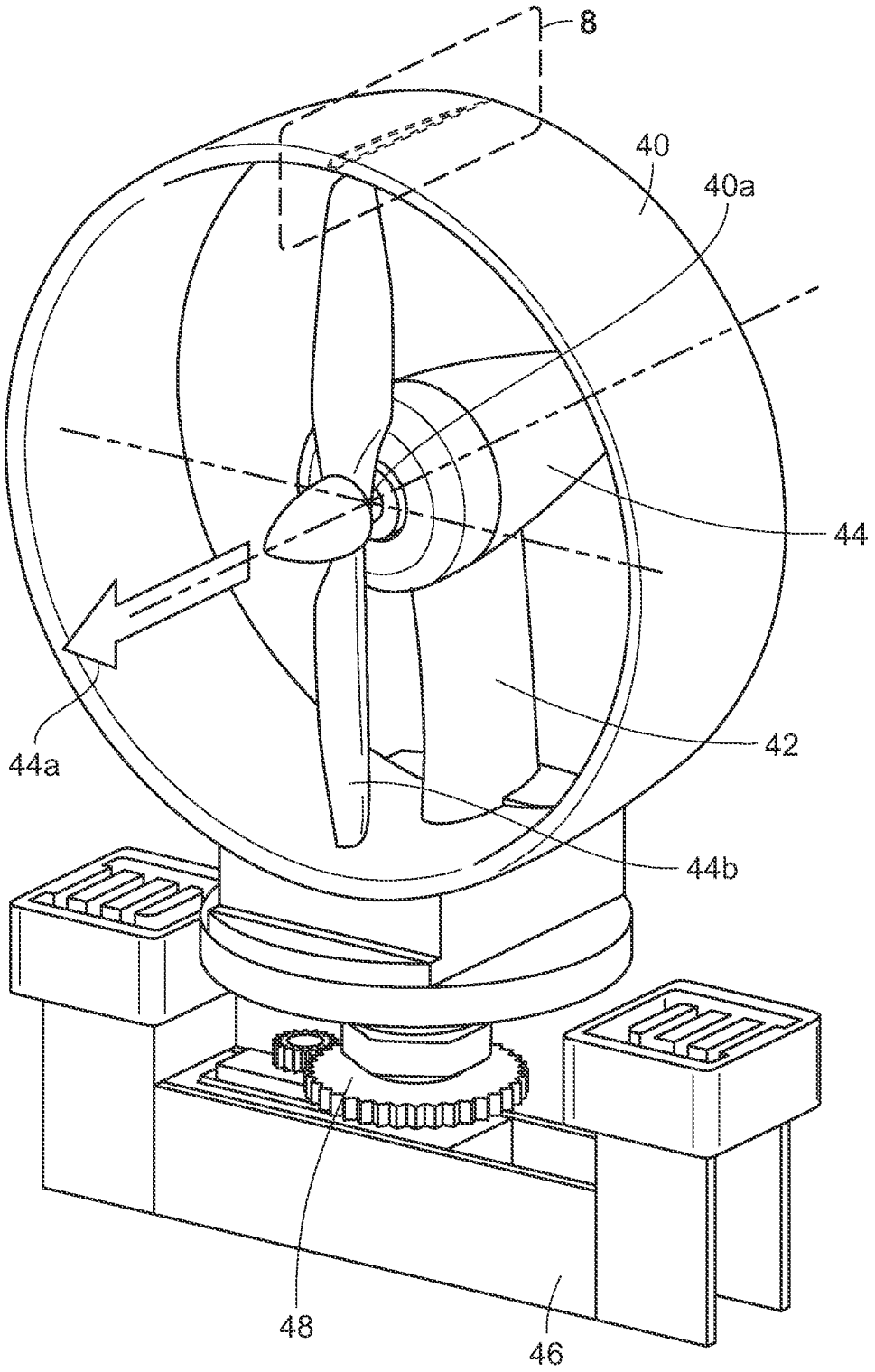
FIG. 7 is a top view of the second preferred embodiment of the inventive propulsion rudder.
Figure 8:
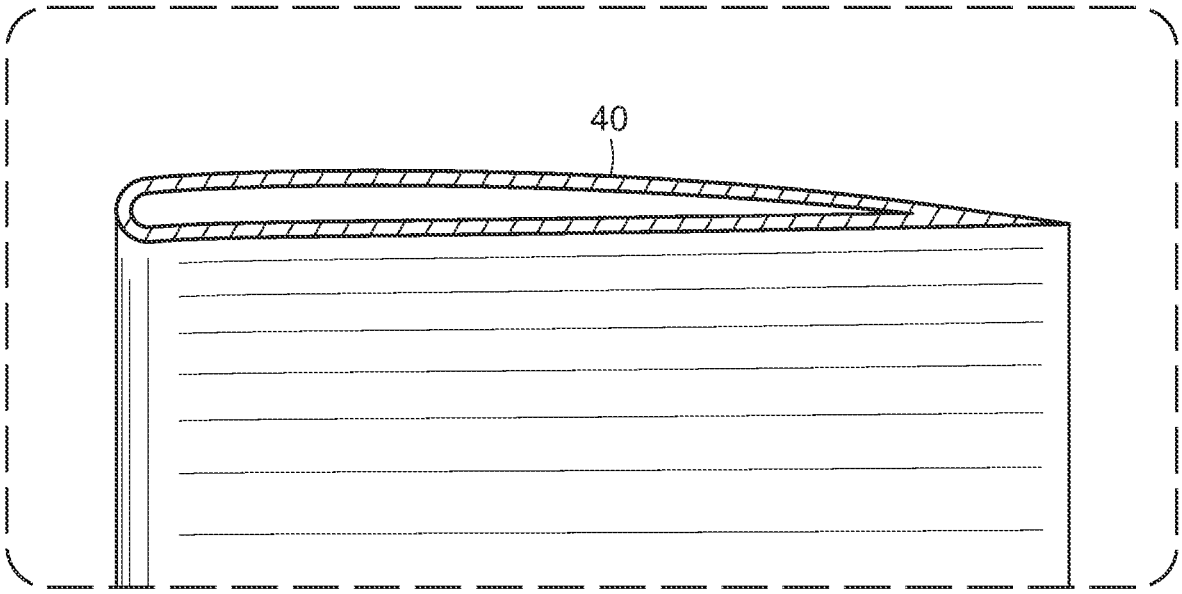
FIG. 8 is a partial cross-sectional view of the second preferred embodiment of the inventive propulsion rudder taken through box 8 of FIG. 7.

As shown in FIG. 7, the propeller engine 44 is disposed within the airfoil 40 such that the ends 44*b* of the propeller are proximate to an inner surface thereof. In this configuration, the effectiveness of the propeller engine 44 is increased because any air loss normally experienced from the ends 44*b* of an exposed propeller is captured and redirected toward the rear of the airfoil 40. This increases the thrust vector 44*a* that is generated. As shown in FIG. 8, the airfoil 40 has a cross-section has an aerodynamic shape from leading face to trailing edge.

The base 12 is mounted on a bracket frame 46 within the body of the vessel 18. A series of geared connections 48 provides the functionality to rotate the base 12 as described above, with a range of one-hundred eighty degrees both clockwise and counter-clockwise. In addition, to minimize weight of the propulsion rudder 10*b*, the bracket frame 46 may be provided with holes (not shown) across the surface thereof. Such holes would reduce the weight of the frame 46 pieces without reducing the integrity of the frame 46.

The second preferred embodiment further includes the computer 30, with GPS module 32, gyroscope 34, and speed controller 36 as described above. These components function to propel and steer the vessel 18 also as described above.

From the above descriptions it is apparent that the preferred embodiments achieve the object of the invention. The disclosed embodiments are merely exemplary of the invention, which may be embodied in various forms. Alternative embodiments and various depictions of the present embodiments will be apparent to those skilled in the art. Various modifications may be made without departing from the scope and spirit of the invention. Accordingly, the invention is not to be limited, except as by the appended claims.

What is claimed is:

1. A propulsion rudder for a water vessel, comprising:

a generally circular base rotatingly attached to an upper surface of the water vessel, wherein the base is configured to rotate through three hundred sixty degrees around a vertical axis relative to the water vessel;

an onboard computer operationally connected to the base so as to rotate the base around the vertical axis;

an aerodynamic rudder assembly attached to the base and extending above the upper surface of the water vessel; and a thrust assembly operationally connected to the rudder assembly, wherein the thrust assembly produces a thrust vector generally perpendicular to the vertical axis.

2. The propulsion rudder of claim 1, wherein the rudder assembly comprises two mast rudders attached to the base spaced equidistant to either side of the vertical axis about which the base is configured to rotate.

3. The propulsion rudder of claim 2, further comprising an aerodynamic horizontal wing that spans between the two mast rudders, wherein the horizontal wing is configured to move at a pivot angle in a range of about forty-five degrees above and forty-five degrees below a horizontal plane.

4. The propulsion rudder of claim 3, wherein the thrust assembly is attached to the horizontal wing between the two mast rudders and the thrust vector is aligned with the pivot angle of the horizontal wing.

5. The propulsion rudder of claim 1, wherein the onboard computer is also operationally connected to the thrust assembly so as to control the thrust vector.

6. The propulsion rudder of claim 5, wherein the onboard computer comprises a GPS module and a gyroscope configured to calculate position and orientation of the water vessel.

7. The propulsion rudder of claim 1, wherein the rudder assembly comprises an annular airfoil attached to the base such that the vertical axis about which the base is configured to rotate passes through a center of the annular airfoil.

8. The propulsion rudder of claim 7, further comprising a central mast that extends from the base to the center of the annular airfoil, wherein the thrust assembly is attached to the central mast and disposed at the center of the annular airfoil.

9. The propulsion rudder of claim 1, wherein the thrust assembly comprises a propeller, a turbine, a ramjet, or a rocket.

10. A propulsion rudder for a water vessel, comprising:

a generally circular base rotatingly attached to an upper surface of the water vessel, wherein the base is configured to rotate through three hundred sixty degrees around a vertical axis relative to the water vessel;

an aerodynamic rudder assembly attached to the base and extending above the upper surface of the water vessel, wherein the rudder assembly comprises two mast rudders attached to the base spaced equidistant to either side of the vertical axis about which the base is configured to rotate;

a thrust assembly operationally connected to the rudder assembly, wherein the thrust assembly produces a thrust vector generally perpendicular to the vertical axis; and an onboard computer operationally connected to the base so as to rotate the same.

11. The propulsion rudder of claim 10, further comprising an aerodynamic horizontal wing that spans between the two mast rudders, wherein the horizontal wing is configured to move at a pivot angle in a range of about forty-five degrees above and forty-five degrees below a horizontal plane.

12. The propulsion rudder of claim 11, wherein the thrust assembly is attached to the horizontal wing between the two mast rudders and the thrust vector is aligned with the pivot angle of the horizontal wing.

13. The propulsion rudder of claim 11, wherein the onboard computer is operationally connected to the horizontal wing on the rudder assembly so as to pivot the same.

14. The propulsion rudder of claim 10, wherein the thrust assembly comprises a propeller, a turbine, a ramjet, or a rocket.

15. A propulsion rudder for a water vessel, comprising:

a generally circular base rotatingly attached to an upper surface of the water vessel, wherein the base is configured to rotate through three hundred sixty degrees around a vertical axis relative to the water vessel;

an aerodynamic rudder assembly attached to the base and extending above the upper surface of the water vessel, wherein the rudder assembly comprises an annular airfoil attached to the base such that the vertical axis about which the base is configured to rotate passes through a center of the annular airfoil;

a thrust assembly operationally connected to the rudder assembly, wherein the thrust assembly produces a thrust vector generally perpendicular to the vertical axis; and an onboard computer operationally connected to the base so as to rotate the same.

16. The propulsion rudder of claim 15, wherein the onboard computer is also operationally connected to the thrust assembly so as to control the thrust vector.

17. The propulsion rudder of claim 16, wherein the onboard computer comprises a GPS module and a gyroscope configured to calculate position and orientation of the water vessel.

18. The propulsion rudder of claim 15, further comprising a central mast that extends from the base to the center of the annular airfoil, wherein the thrust assembly is attached to the central mast and disposed at the center of the annular airfoil.

19. The propulsion rudder of claim 15, wherein the thrust assembly comprises a propeller, a turbine, a ramjet, or a rocket.

* * * * *